US008215806B2

(12) United States Patent
Kwon

(10) Patent No.: US 8,215,806 B2
(45) Date of Patent: Jul. 10, 2012

(54) COOLING DEVICE FOR LAMP WITH POWER LIGHT EMITTING DIODE

(75) Inventor: Heui Kwang Kwon, Busan (KR)

(73) Assignee: Sun Lighting Co., Ltd., Busan (KR)

( * ) Notice: Subject to any disclaimer, the term of this patent is extended or adjusted under 35 U.S.C. 154(b) by 352 days.

(21) Appl. No.: 12/677,049

(22) PCT Filed: Sep. 8, 2008

(86) PCT No.: PCT/KR2008/005278

§ 371 (c)(1),
(2), (4) Date: Mar. 8, 2010

(87) PCT Pub. No.: WO2009/035238

PCT Pub. Date: Mar. 19, 2009

(65) Prior Publication Data

US 2010/0326633 A1 Dec. 30, 2010

(30) Foreign Application Priority Data

Sep. 10, 2007 (KR) ..... 10-2007-0091658

(51) Int. Cl.

| | |
|---|---|
| ***F21V 15/00*** | (2006.01) |
| ***F21V 29/00*** | (2006.01) |
| ***F28D 15/00*** | (2006.01) |

(52) U.S. Cl. ..... 362/373; 362/362; 165/104.31

(58) Field of Classification Search ..... None
See application file for complete search history.

(56) References Cited

FOREIGN PATENT DOCUMENTS

| | | | |
|---|---|---|---|
| JP | 2001289548 | A | 10/2001 |
| JP | 2005300663 | A | 10/2005 |
| JP | 2006310044 | A | 11/2006 |
| KR | 1020060090509 | | 8/2006 |

*Primary Examiner* — Natalie Walford
(74) *Attorney, Agent, or Firm* — The Webb Law Firm

(57) ABSTRACT

The present invention refers to a cooling device for lamp with power light emitting diode comprising of a number of cooling water containers containing a circulating pump and a temperature sensor installed to a particular body with lighting installed. Cooling water incoming pipe and extruding pipe connected to the cooling water container above are connected to a cooling water circulation passage of power light emitting diode, so that cooling water flows in circulation within the circulation passage. When the temperature of the circulating cooling water rises to a certain point, the circulation of the particular cooling water container stops operating, and another cooling water container is operated to keep the thermal power light emitting diode at room temperature, so that the durability of the power light emitting diode is lengthened, and maximizes the cooling effectiveness and power-saving.

2 Claims, 4 Drawing Sheets

FIG 2

| Temperature | Durability of LED | 8hours | 10hours | 12hours |
|---|---|---|---|---|
| 25° | 234,000 hours | 80 years | 64 years | 53 years |
| 30° | 191,000 hours | 65.4 years | 52.3 years | 43.6 years |
| 35° | 157,000 hours | 53.7 years | 43.0 years | 35.8 years |
| **40°** | **129,000 hours** | **44.1 years** | **35.3 years** | **29.4 years** |
| 45° | 107,000 hours | 36.6 years | 29.3 years | 24.4 years |
| **50°** | **90,000 hours** | **30.8 years** | **24.6 years** | **20.5 years** |
| 55° | 75,000 hours | 25.6 years | 20.6 years | 17.1 years |
| **60°** | **64,000 hours** | **21.9 years** | **17.5 years** | **14.6 years** |
| 65° | 54,000 hours | 18.4 years | 14.7 years | 12.3 years |
| 70° | 46,000 hours | 15.7 years | 12.6 years | 10.5 years |
| 75° | 39,600 hours | 13.5 years | 10.8 years | 9.4 years |
| 80° | 34,000 hours | 11.6 years | 9.3 years | 7.7 years |
| 85° | 29,500 hours | 10.1 years | 8.8 years | 6.7 years |
| 90° | 25,700 hours | 8.8 years | 7.0 years | 5.8 years |
| 100° | 19,500 hours | 6.6 years | 5.3 years | 4.4 years |
| 105° | 17,100 hours | 5.8 years | 4.6 years | 3.9 years |
| 110° | 15,100 hours | 5.1 years | 4.1 years | 3.4 years |
| 115° | 13,300 hours | 4.5 years | 3.9 years | 3.0 years |
| 120° | 11,700 hours | 4.0 years | 3.2 years | 2.6 years |
| 125° | 10,500 hours | 3.5 years | 2.8 years | 2.3 years |
| 130° | 9,300 hours | 3.1 years | 2.5 years | 2.1 years |
| 135° | 8,300 hours | 2.8 years | 2.2 years | 1.9 years |
| 140° | 7,500 hours | 2.5 years | 2.0 years | 1.7 years |
| 150° | 6,000 hours | 2.0 years | 1.6 years | 1.3 years |

※ Method for temperature measurement :
Temperature of soldered part of LED is measured using
a digital thermometer ( example: 12° per 1W of power LED × 20W = 240°0 )

FIG 3

| Temperature | Durability of LED | energy efficiency | light efficiency |
|---|---|---|---|
| 20° | 293,200 hours | 154 % | 244 % |
| 25° | 234,000 hours | 143 % | 206 % |
| 30° | 191,000 hours | 133 % | 178 % |
| 35° | 157,000 hours | 124 % | 156 % |
| 40° | 129,000 hours | 116 % | 138 % |
| 45° | 107,000 hours | 109 % | 123 % |
| 50° | 90,000 hours | 103 % | 113 % |
| 55° | 75,000 hours | 98 % | 105 % |
| 60° | 64,000 hours | 94 % | 100 % |
| 65° | 54,000 hours | 86 % | 99 % |
| 70° | 46,000 hours | 80 % | 97 % |
| 75° | 39,600 hours | 75 % | 93 % |
| 80° | 34,000 hours | 71 % | 87 % |
| 85° | 29,500 hours | 68 % | 78 % |
| 90° | 25,700 hours | 65 % | 69 % |
| 95° | 22,200 hours | 62 % | 58 % |
| 100° | 19,500 hours | 59 % | 53 % |
| 105° | 17,100 hours | 57 % | 50 % |
| 110° | 15,100 hours | 55 % | 49 % |
| 115° | 13,300 hours | 53 % | 48.5 % |
| 120° | 11,700 hours | 52 % | 48 % |
| 125° | 10,500 hours | 51 % | 47.5 % |
| 130° | 9,300 hours | 50 % | 47 % |
| 135° | 8,300 hours | 49 % | 46.5 % |
| 140° | 7,500 hours | 48 % | 46 % |
| 145° | 7,000 hours | 47 % | 45.5 % |
| 150° | 6,000 hours | 46 % | 45 % |

※ Method for temperature measurement :
Temperature of soldered part of LED is measured using a digital thermometer
( example: 12° per 1W of power LED × 20W = 240°0 )

COOLING DEVICE FOR LAMP WITH POWER LIGHT EMITTING DIODE

TECHNICAL FIELD

The present invention refers to a cooling device for lamp with power light emitting diode comprising of a number of cooling water containers containing a circulating pump and a temperature sensor installed to a particular body with lighting installed. Cooling water incoming pipe and extruding pipe connected to the cooling water container above are connected to a cooling water circulation passage of power light emitting diode, so that cooling water flows in circulation within the circulation passage. When the temperature of the circulating cooling water rises to a certain point, the circulation of the particular cooling water container stops operating, and another cooling water container is operated to keep the thermal power light emitting diode at room temperature, so that the durability of the power light emitting diode is lengthened, and maximizes the cooling effectiveness and power-saving.

BACKGROUND ART

Generally, light emitting diode (LED) forms minority carriers (electrons or electron holes) injected using the P-N formation of a semiconductor; which has advantages of speed, low power consumption and long durability; and these are recombined to emit light. The present invention has an advantage of saving power as it requires 1/10 of power consumption compared to the previous lamps.

Especially for parts requiring a great amount of power consumption such as traffic lights and street lights, power saving can be maximized if the light emitting diode replaces sodium and mercury which are commonly used in the lights.

But, even though the above light emitting diodes are widely used, for example in an electric sign, it has problems, such as, its brightness not being high enough the fulfill the required lighting standard of a street light or lamp, lacking stability as the brightness is easily affected by surrounding temperature.

To overcome the above problems, developments of new light emitting diodes are in progress and a new power light emitting diode of high brightness is developed. The above power light emitting diode is suitable for street lights due to high brightness compared to the previous light emitting diodes, but emitting heat reaches 200? when switched on, and the caused heat shortens of durability of the light emitting diode and causes separation of the light emitting diode from the connecting clamp due to melting of soldered joint.

Therefore, to lengthen the durability of the above power light emitting diode and to stabilize the brightness, the emitted heat needs to be cooled to keep room temperature.

To prevent and cool the emitted heat above, an air-cooled system was installed to lamps using power light emitting diode, but the air-cooled system failed to overcome the above problems as the cooling effect was unsatisfactory and stability of the temperature was not obtained.

To overcome the above problems, a water cooling system is previously invented. The previous invention comprises of a heat insulator installed on the surface of the substrate with a light installed. The heat transferring part of the above heat insulator is formed of a passage for refrigerant (cooling water), a refrigerant entrance and a refrigerant exit, so that when refrigerant is provided through the refrigerant entrance, the refrigerant circulates the passage inside the heat insulator to absorb the heat of the light, so that the surrounding temperature of the lamp light is decreased due to the cooling water.

But the above previous invention stores the refrigerant separately to the above lamp light which complicates the formation of the device and increases the manufacturing cost. Also, because the cooling system is of a one-sided formation, it cannot provide cooling water of a suitable temperature when the temperature of the cooling water is increased due to the emitted heat from the power light emitting diode, which causes change in temperature of power light emitting diode and in stability of brightness. Therefore, even though stability of brightness and cooling effect is initially achieved, the brightness and cooling effect are gradually decreased due to temperature change

DISCLOSURE OF INVENTION

Technical Problem

It is an object of the present invention to provide a cooling device for lamp with power light emitting diode using a water cooling system to decrease the emitted heat of power light emitting diode and to stably preserve the decreased temperature so that the durability of the power light emitting diode is increased. To achieve the above, a number of cooling water containers with cooling water, cooling water circulation pump and a temperature sensor is installed inside the lamp light, a cooling pipe joint to the circulation pump of cooling water container is connected to cooling water circulation passage, and a cooling water circulation controller; for controlling the circulation pump; connected to the temperature sensor is installed, so that when the temperature of the cooling water rises to reach a certain point, another cooling water container is operated to circulate new cooling water, which stably preserves the temperature.

Technical Solution

A detailed description of the formation of the present invention to achieve the above aim is as follows.

According to the present invention, the body of the device comprises of a connecting clamp (1) of power light emitting diode and a cooling water container (2); a circulation pump (3) inside the cooling water container (2); a power light emitting diode connected to the connecting clamp (1); a heat grease (17) is applied between the above power light emitting diode (4) and the connecting clamp (1); inside the above connecting clamp (1), a cooling water circulation passage (5) is installed closely to the connecting part of the power light emitting diode (4); and a cooling water incoming pipe (6) and a cooling water draining pipe (7) are connected to the cooling water circulation passage (5).

A few cooling water containers (2) are prepared, and each cooling water incoming pipe (6) and cooling water draining pipe (7) are connected to the circulation passage (5). The above cooling water incoming pipe (6) allows cooling water to flow from the cooling water container (2) to the cooling water circulation passage (5), and return the cooling water container (2) after circulating the cooling water circulation pipe (5). One side of the cooling water incoming pipe is connected to the cooling water circulation pump (3) inside the cooling water container (3). One side of cooling water draining pipe (7) is connected to the cooling water draining hole (10) of the circulation passage (5), and the other side is connected to the cooling water container (2).

As stated above, a few cooling water containers (2) are prepared, and each cooling water incoming pipe (6) and cooling water draining pipe (7) of the cooling water container (2)

are connected to the cooling water circulation passage (5) of the connecting clamp (1) of the power light emitting diode.

Also, a thermometer (11) is installed inside the cooling water container (2), and the above thermometer (11) is connected to the cooling water circulation controller (12). The cooling water circulating pump (3) inside the cooling water container (2) is controlled by the cooling water circulation controller (12) connected to the thermometer (11).

The cooling water which circulates the circulation passage (5) and the cooling water container (2) is composed of distilled water with Ethylene Glycol.

The cooling water container; comprising of the cooling water (8), the cooling water circulation pump (3), and the thermometer (11); and the cooling water passage (5) are connected to cooling water incoming pipe (6) and the cooling water draining pipe (7), and when power is supplied for switching on the power light emitting diode, the cooling water circulation pump (3) is operated so that cooling water is supplied to the circulating passage (5) through the cooling water incoming pipe (6). Then the cooling water circulates the circulating passage (5) absorbing the caused heat, and the heater grease (17) applied between the above power light emitting diode and the connecting clamp (1) helps heat absorption. The heated cooling water returns to the cooling water container (2), so that the heat caused by the power light emitting diode is decreased by the circulating cooling water. The above cooling water circulation pipe is installed inside the connecting clamp and closely to the soldered joint of the power light emitting diode, increasing the effectiveness of heat absorption compared to the previous inventions.

Also, in the process of circulating the cooling water (8) by the circulation pump (3) to absorb the caused heat, and when the temperature of the cooling water is increased, the sensor of the thermometer is operated to send temperature signals to the circulation controller (12). Then the circulation controller (12) stops operating the circulation pump (3) so that circulation of cooling water, and starts operating another circulation pump (3*a*) of the cooling water container (2*a*), so that new cooling water is circulated through the circulation passage (5). Therefore the low temperature of the connecting clamp (1) of the power light emitting diode (4) is kept stably, lengthening the durability of the power light emitting diode, increasing the brightness, and increasing power-efficiency. The cooling water (8) (8*a*) is formed of distilled water with Ethylene Glycol, lowering the freezing point compared to the ordinary distilled water to prevent freezing of the cooling water when installed outside in winter.

Advantageous Effects

The present invention is capable of cooling the heat caused by the power light emitting diode and stably keeping the lowered temperature. Heating is prevented so that the power light emitting diode can stably emit light of high brightness lengthen its durability, increase power efficiency, so that exchanging cost and repairing cost.

BRIEF DESCRIPTION OF THE DRAWINGS

FIG. 2 is a diagram showing a durability chronological chart (by used time per day) according to the heating effect of the power light emitting diode.

FIG. 3 is a diagram showing energy and light efficiency according to the heating effect.

BEST MODE FOR CARRYING OUT THE INVENTION

The present invention of the above formation is described in detail below referring to diagrams.

Figure 1:
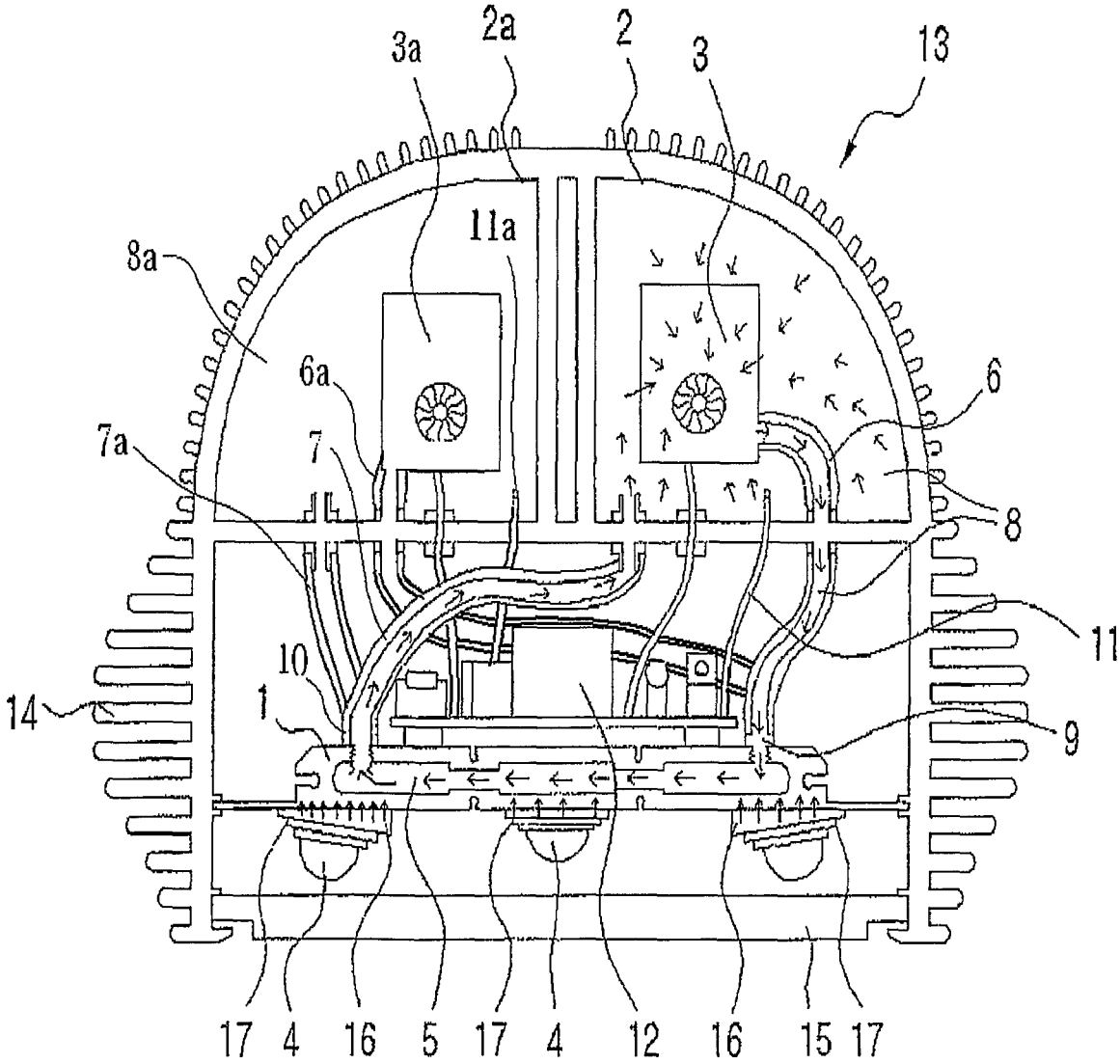
FIG. 1 is a cross-sectional view illustrating the cooling device of the lamp light inside the power light emitting diode.
Figure 4:
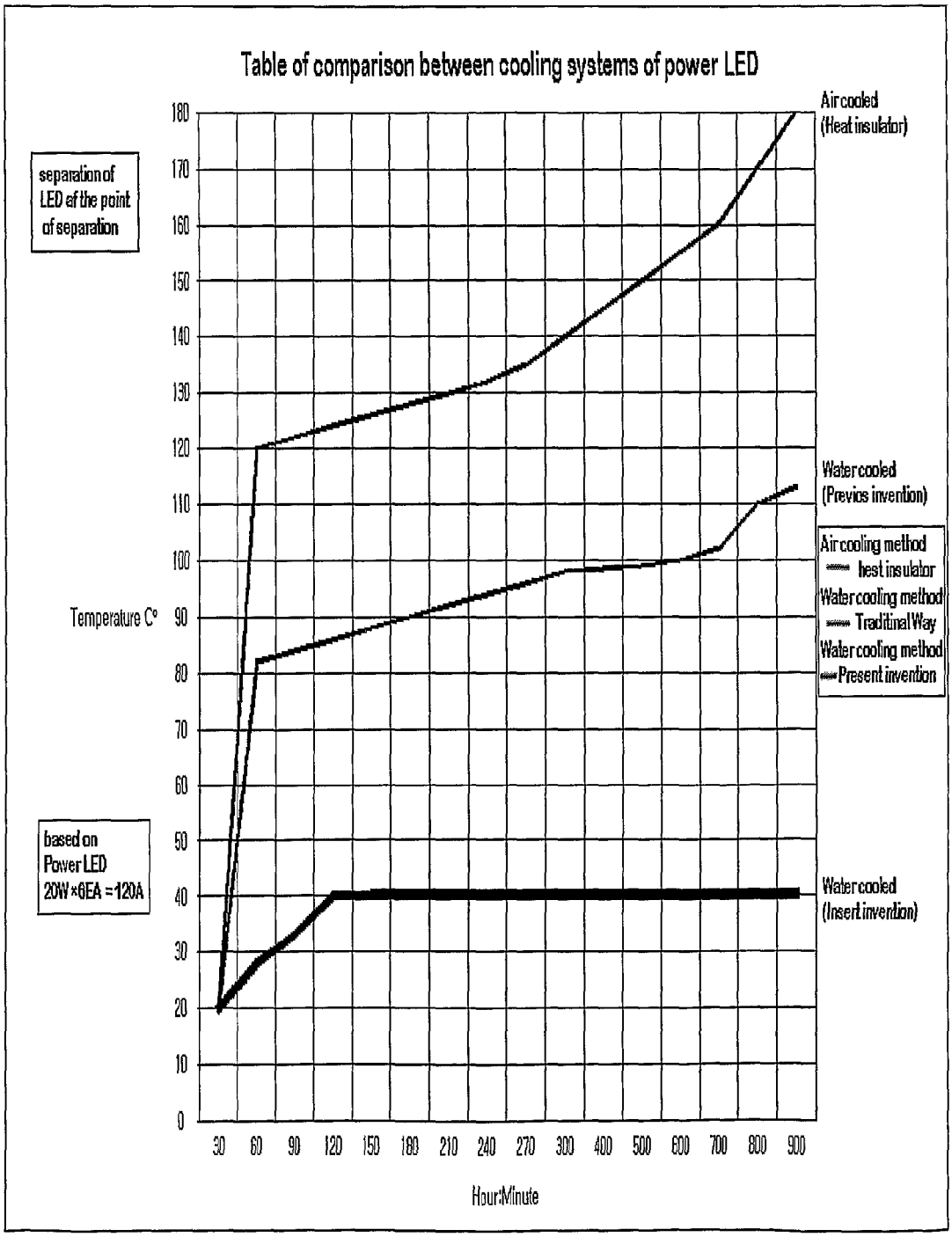
FIG. 4 is a diagram showing comparison between the present and the previous cooling devices.

FIG. 1 is a cross-sectional view illustrating the cooling device of the lamp light inside the power light emitting diode, FIG. 2 is a diagram showing a durability chronological chart (by used time per day) according to the heating effect of the power light emitting diode, FIG. 3 is a diagram showing energy and light efficiency according to the heating effect, and FIG. 4 is a diagram showing comparison between the present and the previous cooling devices.

As illustrated in FIG. 1, an air-cooled insulating board (14) is formed on the surface of semi-circular body (13); cooling water container (2) and cooling water container A(2*a*) comprising of cooling water (8)(8*a*) are formed inside the above semi-circular body (13); and on the upper part of inside the above cooling water container (2) and cooling water container A(2*a*) are installed a circulating pump (3)(3*a*) for circulating the cooling water (8)(8*a*) and thermometers (11) (11*a*) for sensing temperature of the cooling water (8)(8*a*) inside the cooling water container (2) A(2*a*).

On the lower part of inside the semi-circular body (13), that is the lower part of two-layered cooling water container (2) and cooling water container A(2*a*), a power light emitting diode connecting clamp (1) is connected; a number of power light emitting diodes are connected below the above connecting clamp (1); heater grease (17) is applied in between the above power light emitting diode (4) and the connecting clamp (1); and a cooling water circulating passage (5) is formed inside the connecting clamp (1) to circulate cooling water (8)(8*a*).

The above cooling water container (2) and circulating passage (5) of the power light emitting diode (4) are connected to the cooling water incoming pipe (6) and the cooling water draining pipe (10). In more detail, One side of the cooling water incoming pipe (6) is connected to the cooling water circulation pump (3) inside the cooling water container (3). One side of cooling water draining pipe (7) is connected to the cooling water draining hole (10) of the circulation passage (5), and the other side is connected to the cooling water container (2).

the above formation is an explanation of the connected formation of cooling water container (2) and circulation passage (5) formed inside the connecting clamp (10). To connect another cooling water container A(2*a*), a number of cooling water incoming pipes (6) and draining pipes (7) are required, so that the cooling water container A(2*a*) is also connected to the circulation passage (5).

On the upper surface of the connecting clamp (1) with cooling circulation passage (5) formed inside is formed a cooling water incoming pipe (9); cooling water draining pipe (10) and a cooling water controller (12); the above cooling water incoming pipe (6) and the cooling water draining pipe (7) are positioned on either ends of the connecting clamp (1); and in its center is a circulation controller (12); the above cooling water controller (12) is connected to the circulation pump (3)(3*a*) and thermometer (11)(11*a*); the above thermometer continuously measures the temperature of the cooling water (8) of the cooling water container (2), and sends the temperature information to the circulation controller (12);

and the thermometer (11*a*) sends temperature information of the cooling water container A(2*a*) to the circulation controller (12).

The cooling water which circulates the cooling water container (2), cooling water container A(2*a*) and the cooling water circulating passage (5) contains Ethylene Glycol, where the contained amount of Ethylene Glycol depends on the wanted freezing point, and as the contained amount of Ethylene Glycol is increased, the freezing point is lowered. The freezing point of the cooling water (8)(8*a*) of different mixing ratios are as diagram 1 below.

<diagram 1. Different freezing point of the cooling water in different mixing ratios of distilled water and Ethylene Glycol>

| | | | | | | |
|---|---|---|---|---|---|---|
| distilled water | 70% | 65% | 60% | 55% | 50% | 45% |
| ethylene glycol | 30% | 35% | 40% | 45% | 50% | 55% |
| freezing point | −16° C. | −20° C. | −24° C. | −30° C. | −37° C. | −50° C. |

The cooling water (8) of the cooling water container (2) formed inside the semi-circular body (13) is inserted into the circulating passage (5) by the cooling water pump (6) when the power light emitting diode (4) is switched on, and the cooling water (8) inside the circulation passage (5) is circulated to absorb the cause heat of power light emitting diode (4). The cooling water that has completed the circulation within the circulating passage (5) returns to the cooling water container (2) through the cooling water incoming pipe (6) and the cooling water draining pipe (7), and the cooling water that is cooled from the cooling water container (2) is repeatedly inserted back into the circulation passage (5), effectively absorbing the heat produced from the power light emitting diode (4).

The cooling water circulating passage (5) Is installed inside the connecting clamp (1) of the power light emitting diode (4) and closely to the soldered joint of the power light emitting diode (4). Heater grease (17) is applied in between the power light emitting diode (4) and the connecting clamp (1), which helps heat absorption of the cooling water, allowing the cooling water (8) to effectively absorb heat.

In the process of circulating the cooling water (8) by the circulation pump (3) to absorb the caused heat, and when the temperature of the cooling water is increased, the sensor of the thermometer is operated to send temperature signals to the circulation controller (12). Then the circulation controller (12) stops operating the circulation pump (3) so that circulation of cooling water, and starts operating another circulation pump (3*a*) of the cooling water container (2*a*), so that new cooling water is circulated through the circulation passage (5), absorbing the heat of circulating passage (5). The above cooling water (8)(8*a*) is best when kept under 40 C.

The cooling water (8) in the cooling water container (2) is cooled while the above cooling water container A(2*a*) is being operated. A number of air-cooled devices (14) installed on outer layer of of the semi-circular body (13) effectively helps cooling of the heated cooling water (8), also helping the cooling of the heat produced from the power light emitting diode (4). The above air-cooled device (14) can be installed alone or in numbers.

When the above cooling water container (2) is installed in numbers according to the number of the installed power light emitting diode (4), the cooling water for cooling the power light emitting diode (4) is consecutively supplied, preventing the previous problems of heating effects and helping to keep the low temperature stably. Therefore the durability and the brightness of the power light emitting diode is increased, and power-saving effect is achieved as shown in FIG. 3.

The experimented data, FIG. 2 shows that the durability of the power light emitting diode is increased as the temperature is lowered, and as shown in FIG. 3, the power efficiency is increased as the temperature is lowered.

Also, As shown in FIG. 4, the consecutive cooling system is capable of keeping stable temperature compared to previous cooling systems.

Also, the cooling water is formed of distilled water with Ethylene Glycol, lowering the freezing point compared to the ordinary distilled water to prevent freezing of the cooling water when installed outside in winter.

The invention claimed is:

1. A cooling device for a lamp with a power light emitting diode, comprising: a body with a power light emitting diode inside; a lamp light with a transparent board installed below the body; an air-cooled insulating board installed on the outer surface of the body; a connecting clamp which connects the power light emitting diode inside the body; heater grease formed between the power light emitting diode and the connecting clamp; a cooling water container in the inner-upper part of the body, including cooling water, a cooling water circulation pump, and a thermometer; with the cooling water container connected to a cooling water draining hole of a circulating passage; a cooling water circulating pump in the cooling water container and connected to a cooling water incoming hole by a cooling water incoming pipe, and with the thermometer installed inside the cooling water container, and also connected to each circulating pump; and a cooling water circulation controller formed on the upper surface of the connecting clamp for controlling the cooling water circulation pump according to temperature information of the cooling water.

2. The cooling device for a lamp with a power light emitting diode of claim 1, wherein there are at least two of said cooling water containers, cooling water circulation pumps, cooling water incoming pipes, and thermometers and associated cooling water.

* * * * *